United States Patent [19]

Emmie

[11] 4,126,267

[45] Nov. 21, 1978

[54] SECURITY CONTAINER

[76] Inventor: George A. Emmie, 13472 Bryce Rd., Capac, Mich. 48014

[21] Appl. No.: 849,107

[22] Filed: Nov. 7, 1977

[51] Int. Cl.[2] ..... E05G 1/00

[52] U.S. Cl. ..... 232/4 R

[58] Field of Search ..... 232/4, 62, 5, 50, 6, 232/7, 15, 1, 431; 109/66; 312/211; 206/226, 394

[56] References Cited

U.S. PATENT DOCUMENTS

| | | | |
|---|---|---|---|
| 182,826 | 10/1876 | Hoard | 232/5 |
| 423,276 | 3/1890 | Rech, Jr. | 232/4 |
| 3,610,177 | 10/1971 | Shapiro | 232/4 X |
| 3,854,655 | 12/1974 | Armstrong | 232/4 |

FOREIGN PATENT DOCUMENTS

| | | | |
|---|---|---|---|
| 846,471 | 6/1952 | Fed. Rep. of Germany | 232/5 |
| 1,782,061 | 11/1971 | Fed. Rep. of Germany | 232/4 |
| 255,518 | 1/1949 | Switzerland | 232/4 |
| 535,126 | 3/1941 | United Kingdom | 232/1 |

*Primary Examiner*—Roy D. Frazier
*Assistant Examiner*—Peter A. Aschenbrenner
*Attorney, Agent, or Firm*—Basile and Weintraub

[57] ABSTRACT

A security container for storing paper currency comprises an elongated, tubular member, preferably fabricated from metal, and has its opposite ends sealingly enclosed such that the removal of the opposite ends of the container results in the destruction thereof. One of the container ends is in the form of a cap that is press fitted into the tubular end. The cap is provided with a central opening in the form of a cylindrical tube that extends inwardly from the cap into the interior of the tubular member. The cylindrical tube has a diameter which is sized to receive a rolled currency and has a length which is less than the length of the rolled currency such that once the currency is inserted through the tube into the interior of the container, it may not be withdrawn from the container via the tube. No access is provided to the interior of the container, and access to the currency therein is obtained by the destruction of the container.

4 Claims, 4 Drawing Figures

SECURITY CONTAINER

BACKGROUND OF THE INVENTION

I. Field of the Invention

The present invention relates to containers for use principally in storing paper currency and is constructed in such a manner as to require its destruction in order to obtain access to the currency stored therein.

II. Description of the Prior Art

Heretofore, banks for personal use have been well known and have been provided in numerous shapes and sizes and are of many designs. Typical of storage banks are those that are disclosed in U.S. Pat. Nos. 423,276; 3,610,177; and 3,854,655. Each of these patents discloses a structure in the form of a security box having limited access to the interior thereof and being designed such as to provide a simple, strong and effective means of protecting one's money. All of the aforementioned devices, including many of the wellknown prior art banks that are commercially available for personal use, provide a rather simple means for access to the interior of the bank. Access is usually in the form of a key-operated lock or even simpler mechanisms which permit the easy access to the interior of the security container by the proper and lawful owner of the currency therein.

Today many individuals have purchased homes and other property which require yearly payments for taxes and the like. It has become difficult for many people to save money on a continuous basis for the payment of such taxes without the temptation of being able to have easy access to the money and possibly spend it on other matters other than its intended purpose, i.g. the taxes. It would therefore be desirable to provide a security container for home use which will permit the owner to save money for a selected period of time, such as a year, and wherein access to the money within the container is so difficult that the temptation for the premature removal of the money is virtually eliminated.

III. Prior Art Statement

In the opinion of the applicant and applicant's attorney the aforementioned prior art represents the closest prior art of which applicant and applicant's attorney are aware.

SUMMARY OF THE INVENTION

The present invention, which will be described subsequently in greater detail hereinafter, comprises a security container for storing paper currency wherein the container is in the form of an elongated, tubular member having its opposite ends enclosed and wherein one of the opposite ends is in the form of a cap having a central aperture which opens into the interior of the container. The central aperture extends through a tube which has a diameter sized to conveniently receive a rolled paper currency and of a length which is less than the length of the rolled currency, such that insertion of the currency through the tube into the interior of the container prevents its withdrawal therefrom. The container is fabricated from a material which requires the destruction of the container in order to obtain access to the interior thereof.

It is therefore a primary object of the present invention to provide a new and improved security container for home use wherein entry into the container is minimized.

It is a further object of the present invention to provide a security container for home use for storing paper currency and wherein the container is of a simple design and, thus, is easy and inexpensive to manufacture while providing a maximum degree of protection against theft.

It is a further object of the present invention to provide a security container for home use for storing paper currency wherein the container has a decorative appearance and may be utilized as a fixture in a home and wherein its appearance provides a certain secrecy as to its purpose.

Other objects, advantages and applications of the present invention will become apparent to those skilled in the art of security containers for personal use when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENT

Figure 1:
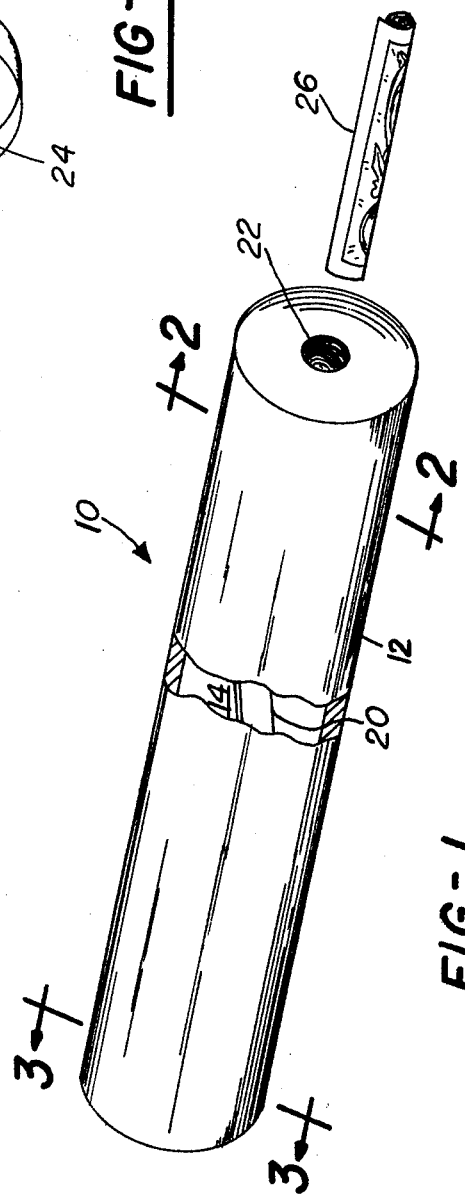
FIG. 1 is a perspective, partially sectioned view of one example of a security container incorporating the principles of the present invention.
Figure 3:
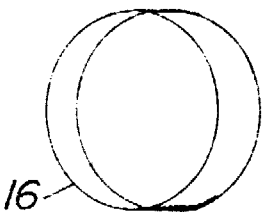
Figure 4:
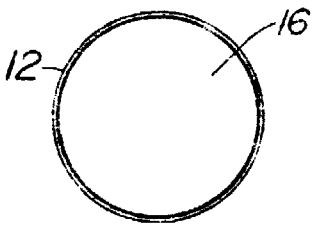
Figure 2:
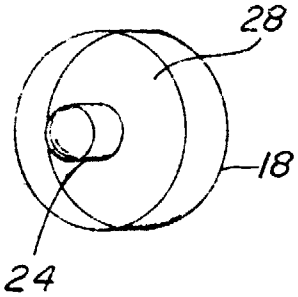
Figure 1:
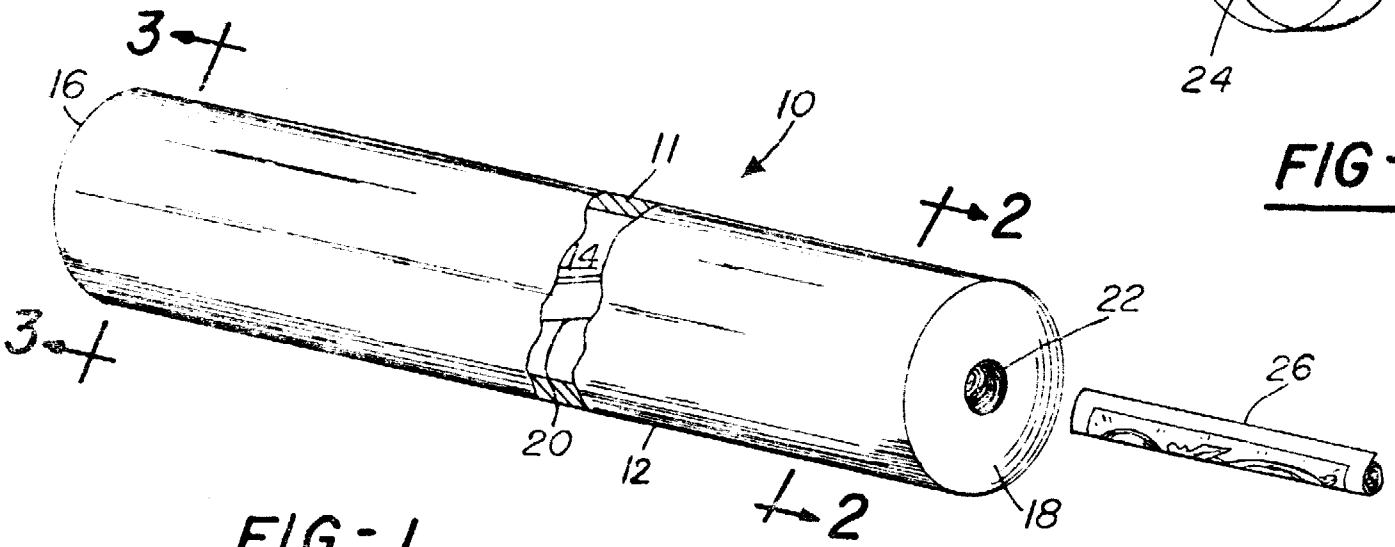

Referring now to the drawing and, in particular, to FIG. 1 wherein there is illustrated one example of the present invention in the form of a security container 10 which is preferably fabricated from an elongated, tubular member 12. The tubular member has a uniform cross-section and a wall thickness 11 which is of suitable strength to prevent access to the interior 14 unless the entire container 10 is destroyed. The member 12 may be fabricated from any suitable material, but preferably the member 12 is fabricated from a metal and is chrome plated for appearance. It should be noted, however, that suitable plastic materials and the like may be utilized in the construction of the inventive tubular member 12. The opposite ends of the tubular member 12 are enclosed by a bottom cap 16 and a top cap 18. The caps 16 and 18 are of a circular configuration, which is complementary to the bore of the tubular member 12, and are received at the opposite ends in the manner illustrated. The caps 16 and 18 are secured to the opposite ends of the tubular member 12 by appropriate means which prevent their removal. Preferably, in a metal construction the caps 16 and 18 may be secured to the opposite ends of the tubular member 12 by appropriately press fitting or crimping the abutting surfaces. A suitable adhesive may be utilized between the members. As can best be seen in FIG. 1 of the drawing, an intermediate flange 20 is disposed in the interior 14 of the tubular member 12 and extends across the longitudinal center of the interior 14, for a purpose to be described hereinafter.

Figure 3:
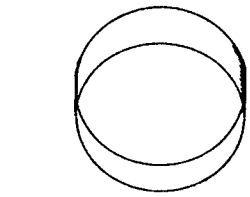
FIG. 3 is a fragmentary, perspective view of the left-end cap as viewed from Line 3—3 of FIG. 1.
Figure 4:
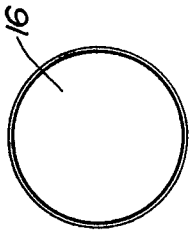
FIG. 4 is a rear elevational view of the security container illustrated in FIG. 1.
Figure 2:
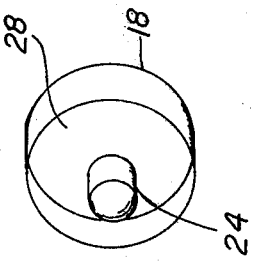
FIG. 2 is a perspective view of the interior of the right-end enclosure cap as viewed from Line 2—2 of FIG. 1.

As can best be seen in FIGS. 1 and 2 of the drawing, the top cap 18 includes a central opening 22 in the form of a cylindrical tube 24 that extends inwardly into the interior 14 of the tubular member 12. Preferably, the tube 24 should have a diameter which is of sufficient size to snugly receive a rolled currency 26. The tube 24 has a longitudinal length extending into the interior 14 of the tubular member 12 a distance which is less than the longitudinal length of the rolled currency 26. It can thus be seen from an inspection of FIGS. 1 and 2 that when the rolled-up currency 26 is inserted into the opening 22 and pushed through the tube 24 until the currency 26 drops into the interior 14 of the tubular member 12, the rolled currency 26 will have a tendency to unroll slightly, bringing it to a diameter which is larger than the diameter of the opening 22. Since the tube 24 extends into the interior away from the interior wall 28 of the cap 18, the potential for removal of the currency 26 from within the interior 14 of the security container 10 is virtually impossible. It should be noted that the insertion of a pipe or the like through the opening 26 for purposes of knocking out the bottom cap 6 is retarded as such an instrument would be blocked by engagement with the flange 20.

It can thus be seen that removal of the currency 26 from the interior 14 of the security container 10 is impossible except for the destruction of the container 10. Since the container 10 is fabricated from an attractive material and may be decorated on the outside as well as chrome plated, the user is reluctant to destroy the attractive and decorative security container unless withdrawal of the money is absolutely necessary or, at least, the withdrawal of the money is for its intended purpose, such as the payment of yearly taxes and the like. Once withdrawal is desired, a saw or other suitable cutting element may be utilized to cut the container 10 in half to remove the currency therein. Such removal, of course, results in the complete destruction of the security container 10.

It can thus be seen that applicant has disclosed a new and improved security container which is extremely simple in its design and, thus, is easy and inexpensive to manufacture, yet one which provides a maximum amount of protection not only against theft because its unique appearance disguises its purpose, but it functions to inhibit the lawful owner from removing currency before a desired time period has expired.

It should be understood by those skilled in the art of security containers for personal use that other forms of applicant's security container may be had, all coming within the spirit of the invention and scope of the appended claims.

What is claimed is as follows:

1. A security container for storing paper currency, said container comprising:

an elongated, tubular member opened at its opposite ends;

first cap means enclosing one end of said member, said cap means being secured to said one member end in such a manner that its removal from said one member end destroys said container;

a second cap means enclosing the other end of said member, said second cap means being secured to said other member end in such a manner that the removal of said second cap from said member destroys said container; said second cap means having an opening having a diameter sized to permit the insertion therethrough of a rolled paper currency, said opening being in the form of a cylindrical tube extending in from said second cap inner surface longitudinally into the interior of said member, said tube having a longitudinal length which is less than the length of said rolled paper currency, said container being fabricated from a material which inhibits access to the interior of said container, access to said container being obtained by the destruction of said container.

2. The security container defined in claim 1 wherein said container is fabricated from metal.

3. The security container defined in claim 2 wherein said security container has a cylindrical shape.

4. The security container defined in claim 2 wherein said container further comprises a flange member laterally disposed in said member and intersecting a line extending through the center of said opening to prevent the engagement of an instrument passing through said opening with the bottom of the other of said cap means.

* * * * *

UNITED STATES PATENT AND TRADEMARK OFFICE

CERTIFICATE OF CORRECTION

PATENT NO. : 4,126,267

DATED : November 21, 1978

INVENTOR(S) : George A. Emmie

It is certified that error appears in the above-identified patent and that said Letters Patent are hereby corrected as shown below:

The sheet of drawing containing Figs. 1 thru 4 should be deleted to appear as shown on the attached sheet Signed and Sealed this

*Eighth* Day of *May 1979*

[SEAL]

*Attest:*

RUTH C. MASON
*Attesting Officer*

DONALD W. BANNER
*Commissioner of Patents and Trademarks*